United States Patent [19]

Panther

[11] Patent Number: 5,040,350

[45] Date of Patent: Aug. 20, 1991

[54] GROUT RETAINER FOR CONCRETE AND LIKE STRUCTURES

[75] Inventor: Kieran Panther, St. Louis, Mo.

[73] Assignee: W. G. Block Co., Davenport, Iowa

[21] Appl. No.: 617,340

[22] Filed: Nov. 23, 1990

[51] Int. Cl.[5] ..... E01C 11/18

[52] U.S. Cl. ..... 52/704; 411/517; 411/521

[58] Field of Search ..... 52/704, 127.3; 411/517, 411/518, 519, 521, 525, 526, 533, 353

[56] References Cited

U.S. PATENT DOCUMENTS 3,417,650 9/1966 Varrin ..... 52/704

*Primary Examiner*—Richard E. Chilcot, Jr.
*Assistant Examiner*—Wynn E. Wood
*Attorney, Agent, or Firm*—Henderson & Sturm

[57] ABSTRACT

The disclosed retainer is useful in tying together sections of concrete or like elements; e.g., in roads, highways and the like, especially where a new section is laid next to and is positively joined to an existing section by several dowels inserted into drilled holes in the old section and left protruding to interlock with the poured new section. The function of the retainer is to slip over the dowel to abut the old section and to prevent leakage of the grout or other adhesive used to cement the dowel to the old section. The retainer of the present invention is preferably a disk of relatively stiff but flexible material having a central circular opening to fit frictionally over the dowel. The opening is bordered by a circular rabbet to provide an annular flange of reduced thickness compared to the major area of the disk and the flange is interrupted at angularly spaced portions to increase the flexibility of the opening-bordering part of the disk for improving the installation of the disk as well as to increase its resistance to retrograde movement along the dowel.

6 Claims, 1 Drawing Sheet

GROUT RETAINER FOR CONCRETE AND LIKE STRUCTURES

BACKGROUND AND SUMMARY OF THE INVENTION

It is known, especially in road building and road repair installation, to join adjacent sections of concrete, for example, by mechanical means such as dowels and grout. In one example, the transverse upright end of an existing slab is drilled to receive dowels that will project away from the slab to interlock with the newly poured slab. Each drilled hole is somewhat larger than the dowel so as to provide room for grout or adhesive material. It is commonplace to employ a retainer disk slipped over each dowel to abut the end of the old slab for the purpose of retaining the grout. Each such disk has a central circular opening having a tight fit over its dowel and the opening further has a radial notch which provides what is known as a weep hole to vent the grouted dowel of air and excess grout. There are several disadvantages flowing from the nature and use of prior retainers, mainly arising from difficulties in installation, poor dowel-to-disk fit, displacement of the disk via retrograde movement along the dowel, etc.

It is a principal feature of the present invention to provide an improved retainer that eliminates the disadvantages of the prior art, primarily by the design of a disk that is relatively stiff but flexible and that has a central dowel-fitting opening formed to "wipe" the dowel during installation on the dowel and to grip the dowel so as to prevent inadvertent retrograde movement on the dowel after installation. The portion of the disk bordering the opening is of greater flexibility than the remainder of the disk, which materially minimizes breakage, chipping, etc., of the disk during installation. Increase in flexibility of the opening-bordering area of the disk results from providing the bordering flange with radial slits or notches which serve also as weep holes.

Further features, objects and advantages of the invention will become apparent as a preferred embodiment is disclosed in the ensuing description and accompanying drawings.

DETAILED DESCRIPTION OF A PREFERRED EMBODIMENT OF THE INVENTION

Figure 1:
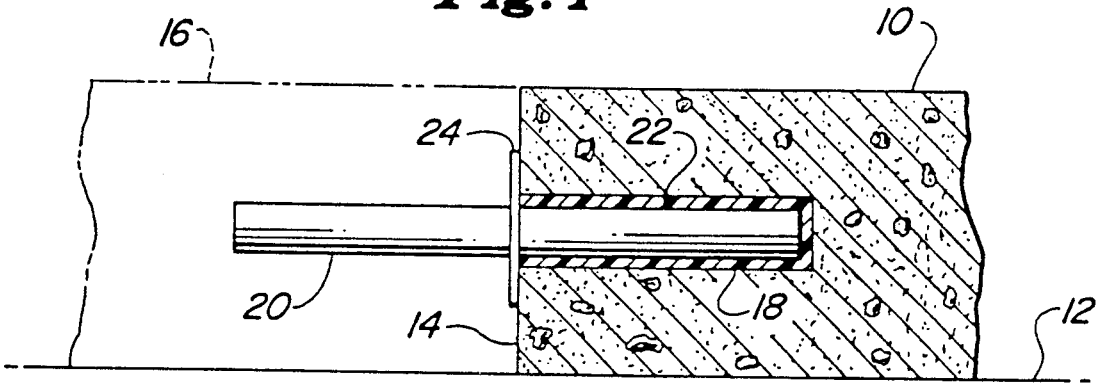
FIG. 1 is a schematic illustration, partly in section, showing a typical dowel joint assembly.

Reference will be had first to FIG. 1 for a background illustration of one of several areas in which the invention finds significant utility. In that Figure an "old" concrete slab or roadway section 10 is shown as resting on the underlying ground 12. This slab has a transverse upright end 14 against which a new slab 16 will be poured. Prior to the pouring of the new section, the end 14 of the prior slab will be drilled horizontally to provide a plurality of blind bores 18, only one being shown. The diameter of the hole will depend on the diameter of the dowel or steel bar to be used. Assuming, by way of example and not limitation, that a dowel or bar 20 of one-inch diameter is used, the hole will be sufficiently over-size to accommodate a suitable quality of adhesive or grout material 22, which may be any appropriate type such as any of the well-known epoxies. The dowel is of such length as to project outwardly into the area to be occupied by the new section 16; thus when the section 16 is poured, it will interlock with the exposed dowel.

Figure 2:
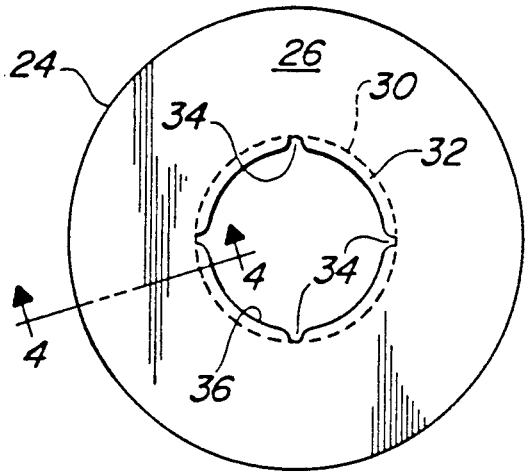
FIG. 2 is a face view of a retainer member or disk as seen from one side.
Figure 3:
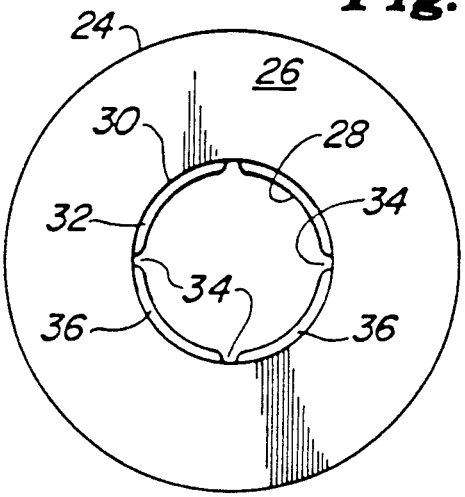
FIG. 3 is a face view of a retaining member or disk as seen from the opposite side.
Figure 3:
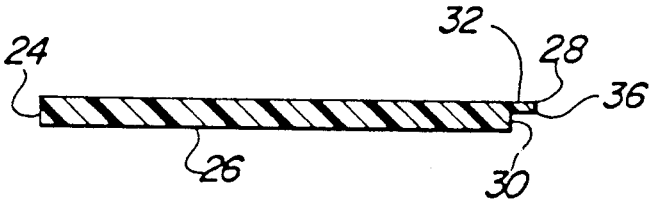
Figure 4:
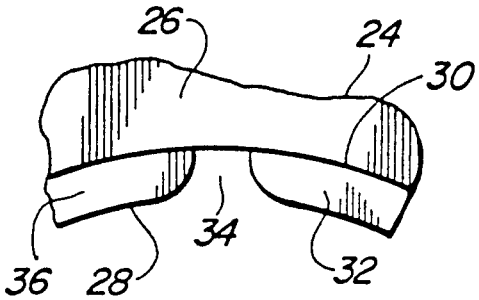
FIG. 4 is an enlarged partial section as seen along the line 4—4 of FIG. 2

Before pouring the new slab, however, the grout must be allowed to set and during this time it must be retained in place around the dowel, a function performed by a retainer element or member 24, shown installed in FIG. 1 and by itself in FIGS. 2 and 3. The member 24 is preferably a disk of relatively stiff yet flexible material and may be conveniently a molded product of plastic such as high-density poly-propylene, being flat or planar end of substantially uniform thickness except in a central area to be described subsequently. In an installation of which FIG. 1 is representative, the disk will have a diameter of, say, three and one-quarter inches and a thickness of 0.065" in its major area 26, which is that area surrounding a central circular opening 28. The opening has a diameter such as to relatively tightly fit the dowel when the disk is slid along the dowel for installation, to the right as seen in FIG 1. In the assumed dowel diameter, the opening diameter would be in the order of 1.04", by way of example.

In order to improve the dowel-to-disk relationship, the opening 28 is provided with a circular lip or periphery in the form of a rabbet 30 which creates an annular flange 32 about the opening. In a disk design of 0.065" thickness the flange will have a reduced thickness of, say, 0.020", about one-third of the major-area thickness. The diameter of the rabbet would be 1.10". Those dimensions may be varied of course, within the limits established by the disk material, diameter, etc., the object being to decrease the thickness of the flange and thus to give it more flexibility than the remainder of the disk, which, when combined with treatment of the flange to be described below, produces the significant advantages of the invention.

Figure 5:
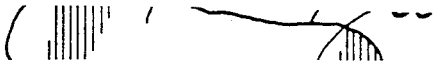
FIG. 5 is an enlarged face view showing the notch configuration.

The disk material may be transparent but is shown here as opaque in order to clarify the nature of the flange 32, shown in full lines in FIG. 3 and in dotted lines in FIG. 2; that is to say, it is more convenient to provide the flange at one face rather than in part at both faces, yet the latter mode is within the purview of the invention. The rabbet is at the face of the disk toward the old slab, which places the flange at the opposite side. Thus the reduced thickness of the disk is at the side opposite to the direction of installation and the flange, being more flexible or resilient than the main body of the disk is fairly easily slipped along the dowel. The flexibility of the flange is further enhanced by the provision of angularly spaced interruptions thereof, preferably by way of a plurality (here four) of notches 34, equally angularly spaced about and radiating from the central opening 28. Each notch has such curved configuration as to converge radially, having thus the tapered shape best seen in FIG. 5. The flange is thus divided into adjoining arcuate portions 36 which serve as wipers relative to the dowel during installation. Moreover, since the wipers yield in the direction opposed to the direction of installation, they tend to grip the dowel and thus prevent or deter relative retrograde movement of the disk, assuring that the disk will remain in place prior to and during pouring of the new slab. The wiping action easily accommodates irregularities in the surface of the dowel, especially where the dowel is coated.

The notches further serve as weep holes and the flange portions intermediate the notches have sufficient area to minimize leakage of grout.

Features and objects other than those pointed out will readily occur to those versed in the art, as will many modifications in the preferred embodiment, all without departing from the spirit and scope of the invention.

I claim:

1. A grout retainer for use with a dowel in the joining of adjacent sections of concrete and the like wherein the dowel has a relatively long portion of substantially uniform circular section providing an exterior surface free from exterior grooves and the like but of somewhat roughened character as by protective coating, said retainer comprising a thin flat planar member having a major area of substantially uniform thickness and of relatively stiff but flexible material, said member having substantially centrally of said major area a circular through opening on an axis normal to said major area and of a diameter but tolerably greater than the diameter of dowel so as to have a relatively tight axially sliding fit with the exterior surface of the dowel as the member is manually advanced lengthwise of the dowel, said fit also serving to retard axial retrograde movement of the member relative to the dowel, said opening being bordered by an annular rabbet that provides a concentric lip of a thickness materially less than the thickness of said major area so that the lip is of greater flexibility than said area and contributes to ease of axial advancement of the member on the dowel and also inhibits retrograde axial movement of the member relative to the dowel.

2. A retainer according to claim 1, in which the lip of the rabbet is interrupted by a plurality of vent notches radiating from the opening.

3. A retainer according to claim 2 in which the notches are confined to the rabbet.

4. A retainer according to claim 3 in which the thickness of the lip is on the order of one-fourth to one-third of the thickness of the major area.

5. A retainer according to claim 1, in which the member is circular, the opening is centrally concentric with the member and the thickness of the major area of the member is on the order of one-twentieth to one-fiftieth of the diameter of the member.

6. A retainer according to claim 5, in which the diameter of the central opening is on the order of one-third the diameter of the member.

* * * * *